United States Patent [19]

Yamashita

[11] Patent Number: 4,587,795

[45] Date of Patent: May 13, 1986

[54] DISCHARGE DEVICE FOR BAG-MAKING, FILLING AND PACKING APPARATUS

[75] Inventor: Kiyoshi Yamashita, Toride, Japan

[73] Assignee: Tokyo Automatic Machinery Works, Ltd., Tokyo, Japan

[21] Appl. No.: 636,988

[22] Filed: Aug. 2, 1984

[30] Foreign Application Priority Data

Feb. 21, 1984 [JP] Japan ..... 59-24062[U]

[51] Int. Cl.[4] ..... B65B 9/08; B65B 1/10

[52] U.S. Cl. ..... 53/551; 53/554; 222/504; 251/65

[58] Field of Search ..... 53/255, 260, 261, 262, 53/248, 550, 551, 552, 553, 554; 141/DIG. 1; 222/157, 502, 504; 251/65, 212

[56] References Cited

U.S. PATENT DOCUMENTS

| | | | |
|---|---|---|---|
| 1,850,589 | 3/1932 | Tourneau | 222/502 |
| 2,573,872 | 11/1951 | Reed | 222/504 |
| 3,879,917 | 4/1975 | Bassendale et al. | 53/552 |
| 3,995,661 | 12/1976 | Van Fossen | 251/65 |

*Primary Examiner*—Horace M. Culver

*Attorney, Agent, or Firm*—Watson, Cole, Grindle & Watson

[57] ABSTRACT

A discharge device for a bag-making, filling and packing apparatus which consists of a bag-making cylinder around which packing film is wound for making a bag and through which commodity article is filled in the bag after the bag is feeded to the lower position consists of magnets for opening and closing movable covers which are provided at the discharge end of the bag-making cylinder. The magnets can be permanent magnets which are movable toward and away from the covers or electromagnets which are stationarily mounted adjacent the covers.

11 Claims, 8 Drawing Figures

DISCHARGE DEVICE FOR BAG-MAKING, FILLING AND PACKING APPARATUS

BACKGROUND OF THE INVENTION

1. Field of the Invention

This invention relates to a bag-making, filling and packing apparatus. More particularly, the invention relates to a discharge device for a bag-making, filling and packing apparatus provided with a bag-making cylinder around which packing film is wound for making a packing bag and through which cylinder commodity articles are filled in the bag after the bag is lowered.

2. Description of the Prior Art

In order to fill in the bag with commodity articles by means of the above-type apparatus, certain time is required for the articles to fall down through the bag-making cylinder. The filling time required is not short. For overcoming this problem, if a cover is provided at the bottom of the cylinder and if additional articles are made to fall down to the cover as the first bag is sealed, the filling time is only the falling time from the cover to the bag and thus the time is shortenend.

In the case where the commodity articles comprise a powder material, a screw conveyor is provided in the bag-making, filling an packing apparatus. Powdered commodity is conveyed and filled in the bag if the screw conveyor is rotated to a predetermined angle. If the conveyor is stopped, an irregular amount of powder will fall down and scatter. If, in this case, a cover is provided at the discharge below the cylinder, such trouble can be prevented.

As is clear from the explanation above, it is advantageous to provide a cover or covers at the discharge below or at the botom of the cylinder. However, the discharge is closed by the bag and the space for the discharge is too narrow to be provided with a mechanism for opening and closing the cover. Therefore, even if the mechanism is provided at the discharge, it does not function well and requires maintenance cost. Moreover, the mechanism of prior art is expensive.

SUMMARY OF THE INVENTION

It is an inherent object of the invention to provide a discharge device which functions well and minimizes the maintenance cost, and which can be assembled at low cost.

The object above is accomplished by providing covers at the discharge of the bag-making cylinder and by providing the mechanism for opening and closing the covers outside the bag.

Specifically, the discharge apparatus of the invention is provided with a mechanism for opening and closing the covers, which consists of openable covers having respective magnet or permanent magnet bodies and of magnets at the position outside the produced bag, and which is operated to open and close the covers by changing the magnet field of these magnets.

The magnet field is changed by the magnets' movement toward and away from each other. The discharge is provided at the bottom end of the cylinder, or at the bottom end of the screw conveyor if the conveyor is provided in the cylinder.

In order that the invention may be more clearly understood, preferred embodiments will be described, by way of example, with reference to the accompanying drawings.

DESCRIPTION OF PREFERRED EMBODIMENTS

Figure 1:
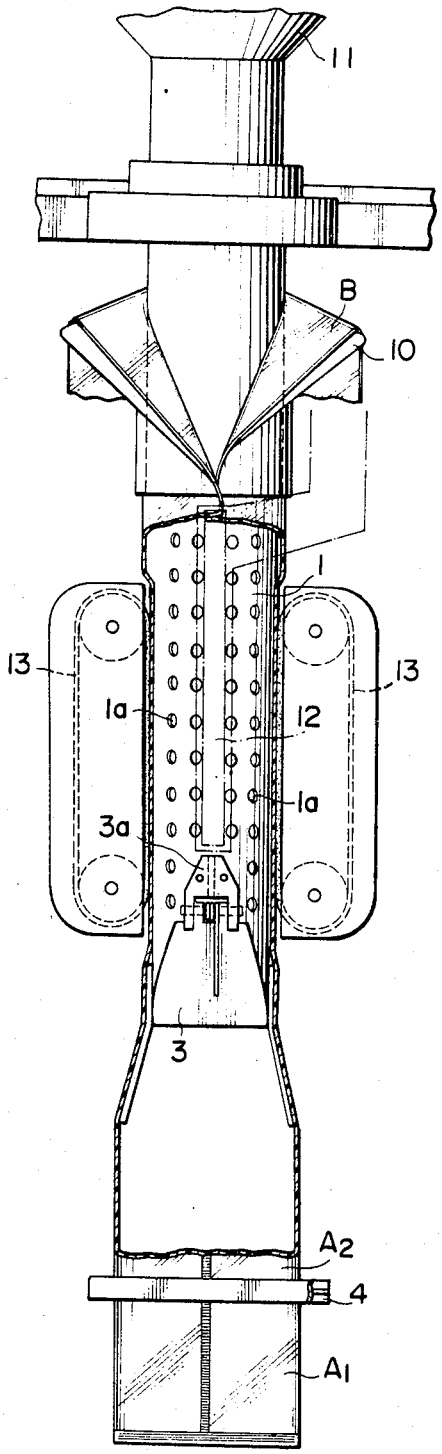
FIG. 1 is a front view, partly cut out, of the first embodiment of the invention.
Figure 2:
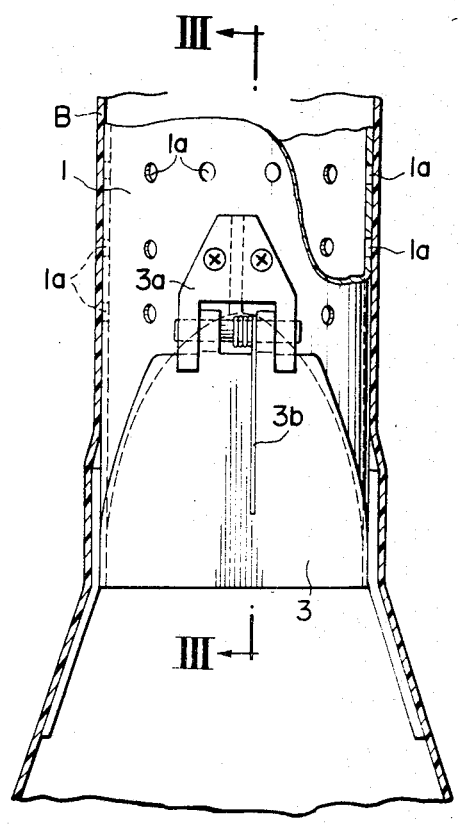
FIG. 2 is an enlarged front view of the main part of the first embodiment.
Figure 3:
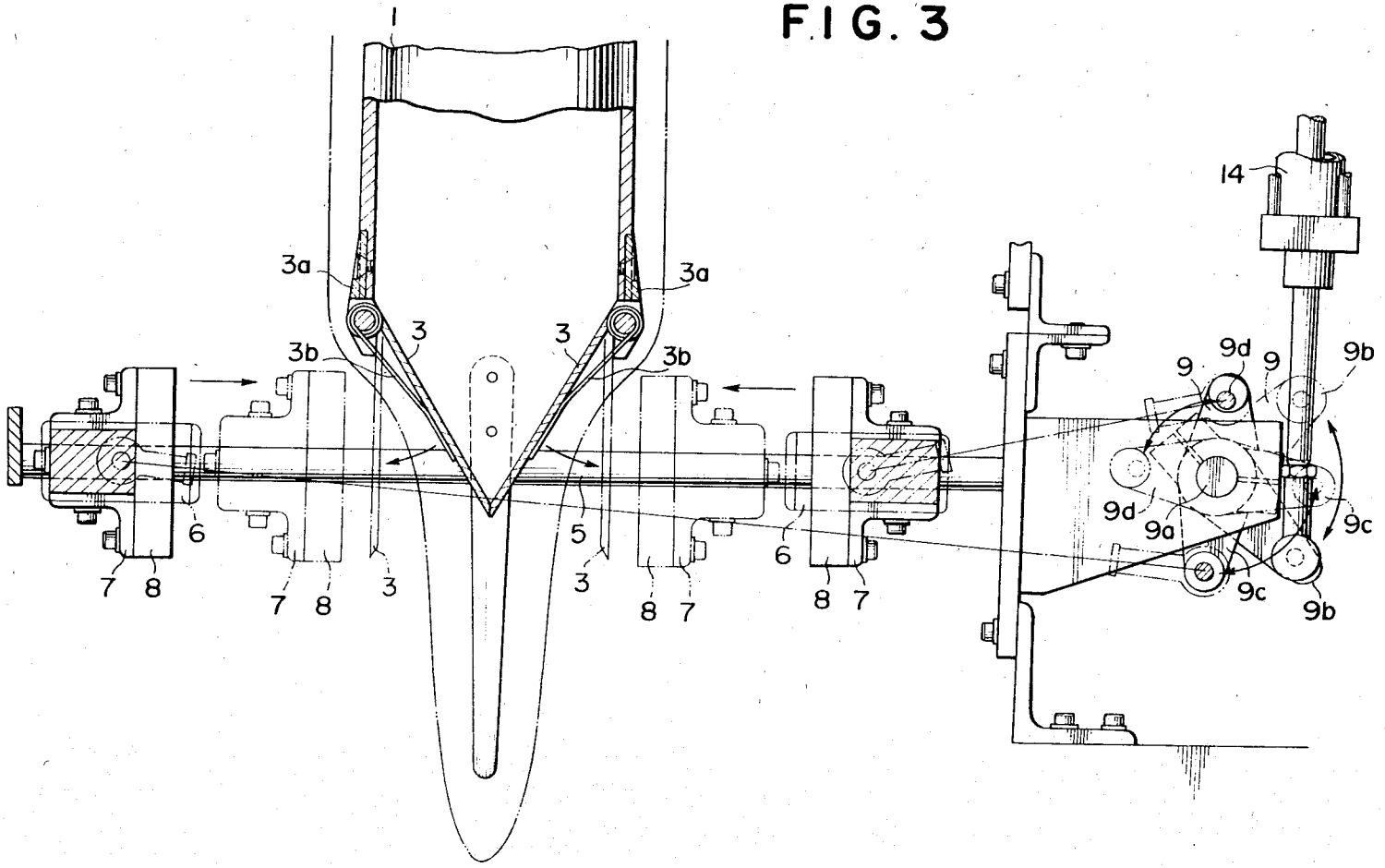
FIG. 3 is an enlarged sectional view along the line (III)—(III) of FIG. 2.

In FIGS. 1 through 3, which illustrate the first embodiment of the invention, a bag-making cylinder 1 is provided with a number of air holes 1*a*, 1*a*, and packing film B is wound around the cylinder.

The air holes 1*a* act to discharge air so as to avoid the situation where covers 3, 3 may not open due to air in the bag when articles of commerce have been put into the cylinder 1. The holes are inclined upwardly to the direction outside the cylinder surface so that articles may not escape therethrough.

The hopper 11 for receiving articles and a sailor device 10 for making package film B cylindrical are provided at the upper part of the bag-making cylinder 1. Further, a sealing device 12 for longitudinally sealing the film B and thus for giving it a cylindrical form are detachably provided to the cylinder.

At two sides of the cylinder are detachably provided feeding belts 13, 13 for feeding the film downwardly. A crosswise sealing device 4 having a cutter is openably provided below the cylinder.

The crosswise sealing device 4 seals the opening part of a first bag $A_1$ and the bottom of a second bag $A_2$ crosswise. Further, the cutter separates the former bag $A_1$ from the latter $A_2$.

The bottom of the cylinder is opened V shape in cross section and is provided with openable covers 3, 3.

The covers 3, 3 consist of steel plates of substantially half-oval shape and can be opened by means of hinges 3*a*, 3*a*. A coil spring 3*b* engages with each of the respective covers so that the covers can be closed thereby.

A mechanism for opening and closing the cover 3 is explained with reference to FIG. 3. A guide bar 5 is provided at respective sides of the cover 3. The guide bar has a sliding member 6. A permanent magnet 8 is mounted to the member 6 by means of a fitting member 7.

A rotating member 9 consisting of three arms 9*b*, 9*c* and 9*d*, rotates arounds a rotary shaft 9*a*. Each arms are connected to an air cylinder 14 and to the sliding member 6.

When the air cylinder 14 reciprocates, the three arms 9*b*, 9*c* and 9*d* rotate. As a result, the permanent magnet 8 moves via the sliding member 6.

The magnetic field generated by the magnet 8 is strong enough to act on the cover 3. The cover opens or closes in synchronism with the movement of the magnet 8.

Next, the operation of the apparatus is explained with reference to the drawings.

Package bag film B is wound around the bag-making cylinder 1 by a sailor device 10. The film is sealed cylindrical around the cylinder by the vertical sealing device 12, and bags $A_1$, $A_2$ produced from the film are feed downward by feeding belts 13, 13.

Then the crosswise sealing device 4 is closed and seals the bottom of later bag $A_2$ and the upper opening of former bag $A_1$ while it cuts the bag $A_1$ from the bag $A_2$. Then the device 4 is opened.

Thereafter the air cylinder 14 is operated so as to open the magnet 8 for opening the cover 3. After one or more articles of commerce are filled in the bag, the air cylinder 14 is operated to counter direction so as to close the cover 3.

Then the feeding belts 13, 13 are operated to feed bags $A_1$, $A_2$ downward. While the bags are sealed crosswise, the next articles are received through the hopper 11 and stored on covers 3, 3. The procedure mentioned above is repeated.

Next, the other embodiments are explained except for similar structures of which references show same structures of the first embodiment.

Figure 4:
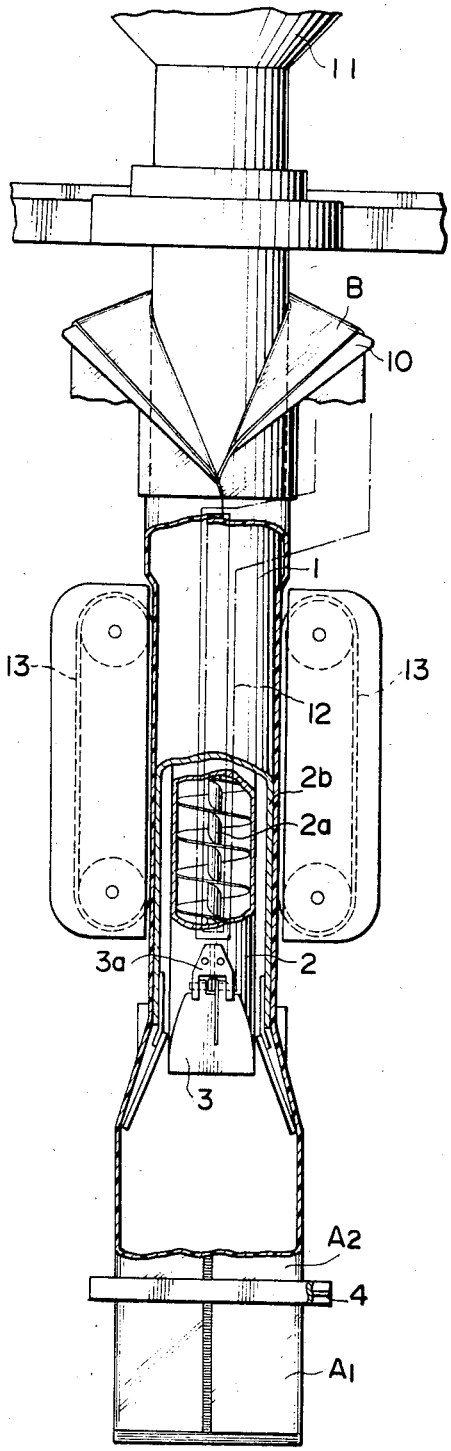
FIG. 4 is a front view, partly cut away, of a second embodiment of the invention.
Figure 5:
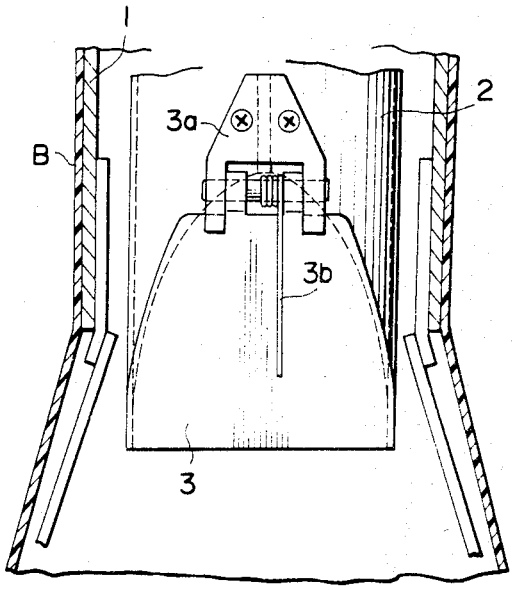
FIG. 5 is an enlarged front view of the main part of the second embodiment.

The second embodiment directed to a bag-making filling and packaging apparatus for powder material for commerce, is explained with reference to FIGS. 4 and 5. A screw conveyor 2 is provided concentrically in a bag-making cylinder 1. The conveyor 2 consists of a pipe 2*b* and a screw shaft 2*a* housed in the pipe 2*b*. When the shaft 2*a* is rotated to a certain angle, a desired amount of powder falls down into a bag $A_2$.

The bottom of the pipe 2*b* is made substantially V in cross section and is provided with covers 3, 3. The structure of the cover and its opening and closing mechanism are identical to those of the first embodiment.

As has been explained above, the apparatus of the invention is applicable also to that for bags of powdered material.

Figure 6:
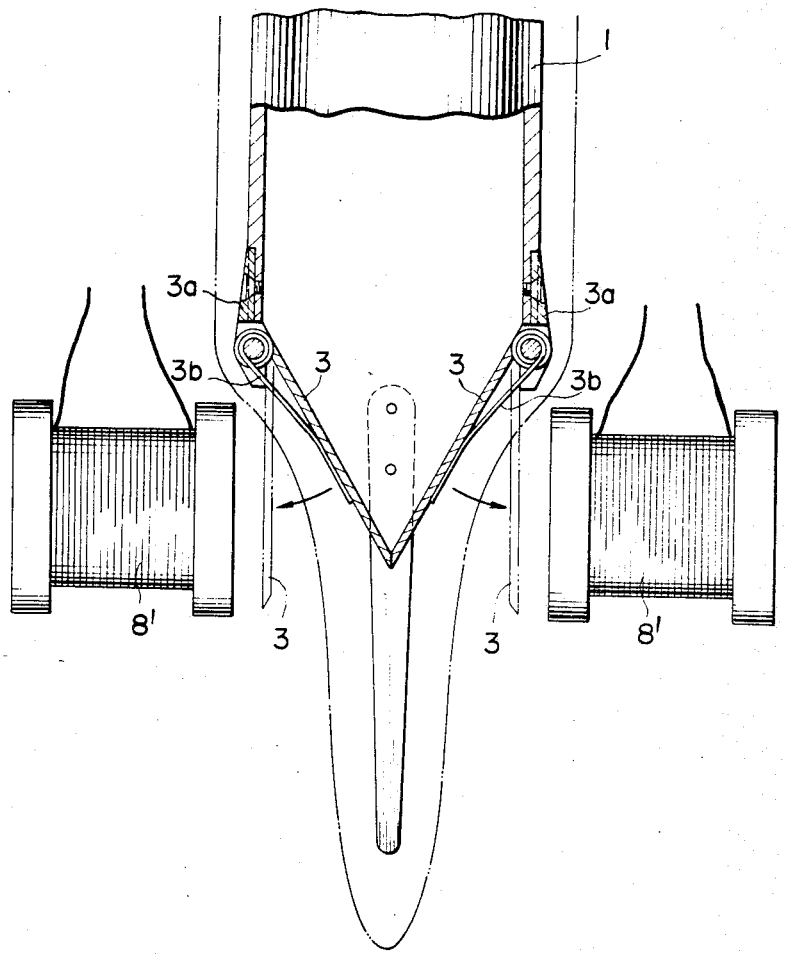
FIG. 6 is a sectional view of a mechanism for opening and closing covers in a third embodiment according to the invention.

The third embodiment is explained with reference to FIG. 6 which illustrates a variation of the opening and closing mechanism. Specifically, the mechanism consists of two electric magnets 8', 8' fixed to positions outside covers 3, 3. When the magnets are "ON" position, the covers are attracted to respective magnets and become open, while covers close due to the action of twisted coil spring 3*b* when the magnets are on "OFF" position. The operation of the third embodiment is identical to that of the first embodiment and is not explained.

Since mechanisms such as an air cylinder used in the first embodiment is not necessary for this embodiment, a simpler and inexpensive structure can be realized.

In all the explained embodiments, the pulling forces of the magnets are utilized, however, the repulsion forces of the magnets may be used as well.

Figure 7:
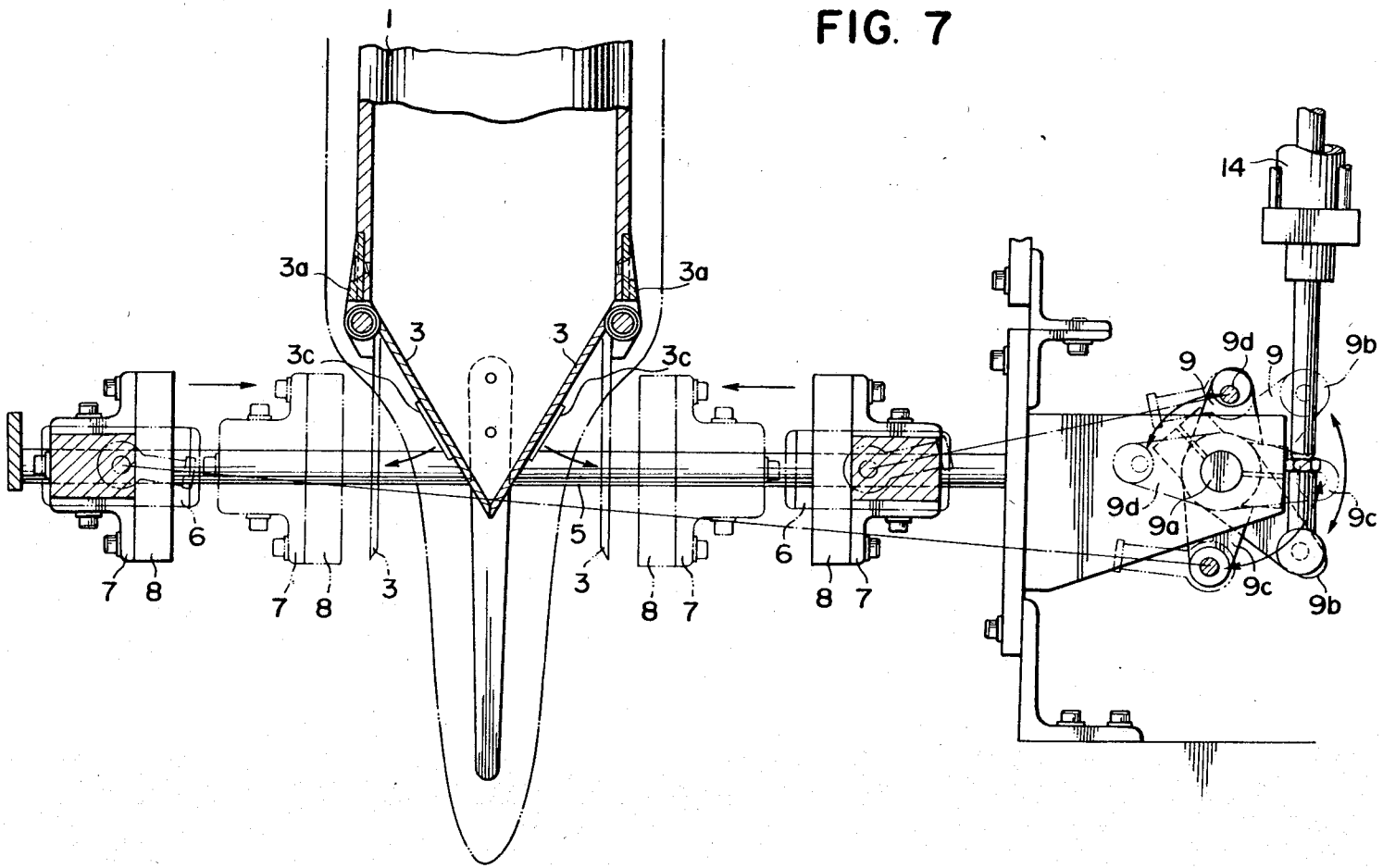
FIGS. 7 and 8 show sectional views similar to FIGS. 3 and 6 of fourth and fifth embodiments of the invention.
Figure 8:
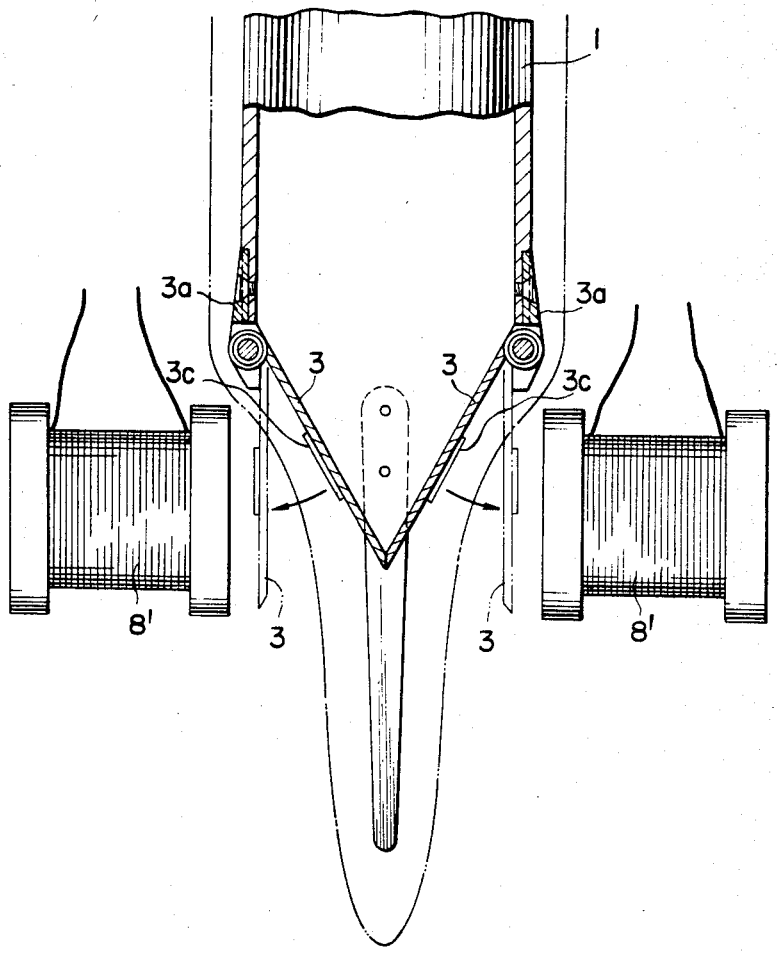

For example, as shown in FIGS. 7 and 8, a magnet plate 3*c* is applied to each of covers 3, 3 in place of the twisted coils 3*b*, 3*b* used in the third embodiment, and if magnetic pole of the same polarity is generated in electromagnets 8', 8', the covers will be closed due to repulsion forces when the electronic magnets 8', 8' are operated to be in an "ON" position, and will be opened due to the covers' own weight in an "OFF"position.

As is clear from the explanation above, the opening and closing mechanism can be easily attached to covers. Even if troubles occur in the device, the bags will not be broken and articles or powders in the bag will not be scattered. Therefore, the discharge device can be repaired easily and its maintenance is effected smoothly.

It is further understood by those skilled in the art that the foregoing description is that of preferred embodiments of the disclosed outlet device for bag-making filling and packing apparatus and that various changes and modifications may be made in the invention without departing from the spirit and scope thereof.

What is claimed is:

1. In an apparatus for forming, filling and closing a series of bags, said apparatus including a bag-making cylinder around which a film can be wrapped to form a cylinder as the film passes along the length of said bag-making cylinder in a downstream direction, and a sealing means located adjacent the downstream end of the cylinder to simultaneously close the open top of a downstream bag and close the bottom of an adjacent upstream bag, said bag-making cylinder enabling commodity articles to pass through the interior thereof and into a bag whose bottom has been closed but whose upstream end is still open, the improvement wherein means are provided for controlling the passage of commodity articles through the interior of said bag-making cylinder and into each successive bag, said means including two movable covers which, when moved together, close the interior of said bag-making cylinder and, when moved apart, open the interior of said bag-making cylinder, and two magnets, each of said two magnets being located adjacent an associated one of said two movable covers at a location outside the film passing over said bag-making cylinder, the magnetic fields of said magnets being capable of acting directly on said covers to move them apart.

2. The apparatus as defined in claim 1, wherein said bag-making cylinder has a donwstream end and wherein said two movable covers are hingingly connected to the downstream end of said bag-making cylinder so that, when moved together, they provide a V-shaped configuration.

3. The apparatus as defined in claim 2, including a screw conveyor located in the interior of said bag-making cylinder for feeding the commodity articles therethrough in a controlled fashion.

4. The apparatus as defined in claim 2, wherein a coil spring is attached to each of said two covers to bias said two covers together to close the interior of said bag-making cylinder.

5. The apparatus as defined in claim 4, wherein each of said two magnets is a permanent magnet, and including support means to move each of said permanent magnets toward and away from its associated cover.

6. The apparatus as defined in claim 5, wherein each said support means includes a guide bar which extends toward its associated cover and a sliding member which is movable along said guide bar towards and away from its associated cover and which mounts one of said two permanent magnets, the magnetic field produced by each of said permanent magnets which are located near its cover being sufficiently strong to overcome the bias created by the coil spring attached thereto.

7. The apparatus as defined in claim 6, including actuation means for simultaneously moving each of said sliding members along its associated guide bar.

8. The apparatus as defined in claim 4, wherein said two magnets are electromagnets, the magnetic field provided by each of said electromagnets, when energized, being sufficiently strong to overcome the bias created on its associated cover by the coil spring attached thereto.

9. The apparatus as defined in claim 2, wherein each of said two magnets is a permanent magnet which is movable toward and away from its associated cover, and wherein each said cover includes a magnetic plate thereon which has a polarity identical to that of the permanent magnet associated therewith, movement of said permanent magnets toward said covers causing said covers to move together due to magnetic field repulsion and movement of said permanent magnets away from said covers allowing said covers to swing apart due to gravity.

10. The apparatus as defined in claim 2, wherein each of said two magnets is an electromagnet and wherein each said cover includes a magnetic plate thereon which has a polarity identical to that of the electromagnet associated therewith, energizing of said electromagnets causing said covers to move together and deenergizing of said electromagnets allowing said covers to swing apart due to gravity.

11. The apparatus as defined in claim 1, wherein said covers are made of steel.

* * * * *